United States Patent [19]

Hayward et al.

[11] 4,015,300

[45] Apr. 5, 1977

[54] FLOTATION JACKET

[76] Inventors: John S. Hayward, 570 Linnet Lane; Martin S. Collis, 2415 Alpine Crescent; John D. Eckerson, West Coast Road; Lorne K. Rosenblood, 965 Kentwood Terrace, all of, Victoria, British Columbia, Canada

[22] Filed: May 6, 1976

[21] Appl. No.: 683,858

[30] Foreign Application Priority Data

Nov. 25, 1975 Canada ..... 240373

[52] U.S. Cl. ..... 9/341; 2/2.1 R; 9/347

[51] Int. Cl.[2] ..... B63C 9/10

[58] Field of Search ..... 9/341, 347, 340, 342, 9/343, 348; 2/76, 2.1 R, 78 B

[56] References Cited

UNITED STATES PATENTS

| | | | |
|---|---|---|---|
| 1,002,912 | 9/1911 | Guy | 9/342 |
| 1,968,197 | 7/1934 | Gazelle | 9/342 X |
| 2,692,994 | 11/1954 | King et al. | 9/342 X |
| 2,722,020 | 11/1955 | Gazelle | 9/341 X |
| 3,744,052 | 7/1973 | Rector | 2/2.1 R |
| 3,840,900 | 10/1974 | Cruz | 2/78 B |

FOREIGN PATENTS OR APPLICATIONS

| | | |
|---|---|---|
| 1,375,266 | 9/1964 | France |

*Primary Examiner*—Trygve M. Blix
*Assistant Examiner*—Gregory W. O'Connor
*Attorney, Agent, or Firm*—Beveridge, DeGrandi, Kline & Lunsford

[57] ABSTRACT

A flotation jacket has flotation material therein to provide adequate inherent buoyancy for adults. A flap of waterproof insulative closed cell material is concealed on the inside of the body of the jacket and can be released therefrom to be converted into panels providing thermal protection in cold water to the lower trunk region of the wearer.

1 Claim, 4 Drawing Figures

FLOTATION JACKET

This invention relates to a survival garment and in particular a survival jacket for protection of the wearer when immersed in cold water. Specifically, the jacket includes a thermal protection portion for insulating the vital heat loss areas in the human body to thereby extend the life expectancy of the wearer in cold water by a substantial factor.

Numerous accidents occur in watercraft, etc. where persons are accidentally immersed in cold water for substantial periods of time and many die from hypothermia, the result of lowered deep body temperature. Unconsciousness can occur when the deep body temperature falls approximately 90° F. (32° C.) and heart failure is the usual cause of death when the body core cools to about 85° F. (30° C.) or below.

The length of survival time in cold water varies in accordance with the survival procedure of the person involved, the weight of the person, amount of body fat, etc. On the average however a predicted survival time is about 2½ to 3 hours in water of 50° F.

Certain body regions have high rates of heat loss while a subject is holding still in cold water. These areas are the sides of the chest where there is little muscle or fat, the head which is normally out of the water and the groin region loses substantial heat due to large blood and lymph vessels near the surface of the skin.

The present invention provides a garment which is suitable for normal wear but which contains a flap member of insulative closed-cell material which can easily be snapped into place to provide thermal protection in the water, or in an exposed situation on land, to the vital heat loss areas in the groin. Flotation and thermal protection are the two main factors to be considered when a subject is faced with the possibility of cold water immersion. While both these can be provided by clothing such as wet suits and closed cell form survival suits, such garments are not appropriate for either recreational wear or for on the job clothing that is required for fishermen, etc. The present invention provides a garment which provides wearability with thermal protection and flotation. The garment provides inherent buoyancy adequate for adults and simple convertibility in or out of the water to provide significant thermal protection to the critical body areas. In 45° to 50° F. water, survival time would be in the region of 8 to 9 hours which is approximately a three fold increase over the standard personal flotation device and more than twice as long as any known available flotation coat. The thermal protection of the garment results from the use of low absorbent closed-cell foam in the groin protection panel with additional insulation in areas of critical heat loss. Additionally, aluminized polyurethane coated nylon is provided for the inner shell of the garment. An improved collar design is also provided as well as a hood adapted to maximize visibility of the wearer for air-sea rescue.

According to a broad aspect, the present invention relates to a flotation jacket having front and back and arm portions with flotation material therein to provide adequate inherent buoyancy for an adult, and a flap secured to the lower terminal edge of the jacket and foldable between a concealed position on the inside of the jacket and a deployed position suspended from the said lower edge of the jacket; said flap, in the deployed position having a main panel for passage between the legs of the wearer and securement to the front of the jacket thereby enclosing the groin area; and a pair of wing panels, one on either side of the main panel, said wing panels being adapted for encirclement of the upper thigh area; and means for securing the panels in their concealed and abdominal enclosing positions; said flap comprising waterproof insulative closed-cell material providing protective thermal protection to vital heat loss areas in the groin and mid-thigh areas of the wearer.

The invention is illustrated by way of example in the accompanying drawings wherein.

Figure 1:
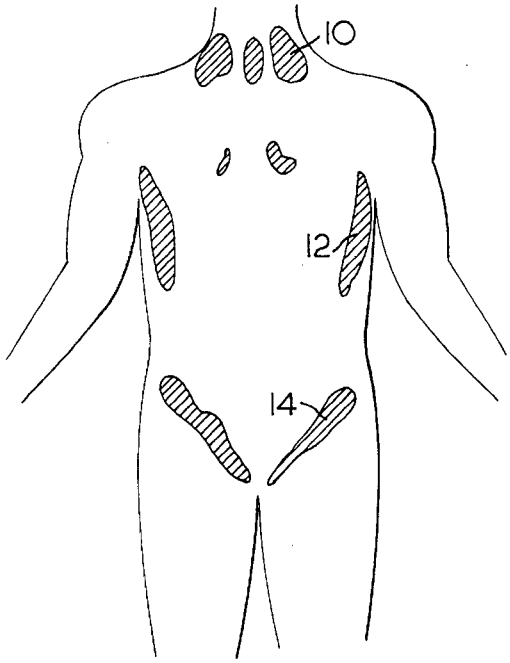
FIG. 1 is a thermogram illustrating surface temperature distributions of the trunk of an adult subject indicating the areas of high heat loss.

Referring to FIG. 1, the drawing depicts a thermogram which illustrates surface temperature distributions of an adult male subject after holding still in water of 7.5° C. for approximately 15 minutes. The heavily shaded areas 10 adjacent the neck of the subject, 12 at the sides of the chest and 14 in the groin areas indicate the areas of greatest heat loss and therefore the areas which require greatest protection in a survival garment.

Figure 3:
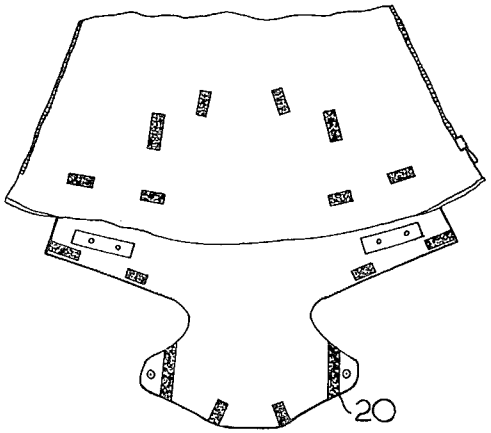
FIG. 3 is a view similar to FIG. 2 but shows the thermal flap in the deployed position and FIG. 4 shows a subject wearing the garment according to the invention with the thermal panel in applied position.
Figure 2:
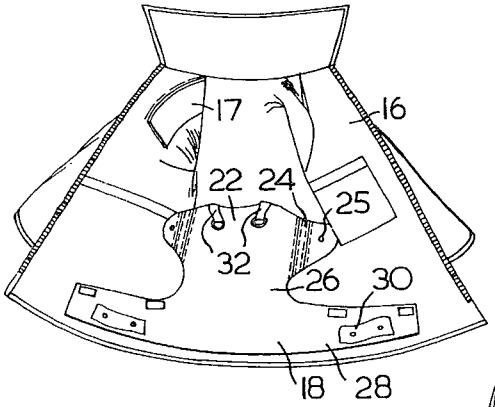
FIG. 2 is a view of the garment made according to the present invention showing the thermal flap in concealed position.

Referring to FIG. 2, a garment according to the present invention comprises a known form of flotation jacket 16 which has been provided with insulative flotation material in the areas of the sides of the chest of the subject and to which has been added a flap 18 secured along the lower terminal edge of the body of the jacket. It will be noted from FIG. 2 and FIG. 3 that the flap is foldable between the concealed position of FIG. 2 where it is held in position by a plurality of velcro fastenings or the like 20 (FIG. 3) and a deployed position shown in FIG. 3 where the panel is ready for fastening by the wearing subject. As shown in FIGS. 2 and 3, the flap 18 has a main panel 22 having a pair of securing tabs 24 at either side thereof. The main panel 22 has primary wings 23 thereon including fastening means 25 and panel 22 is connected by a neck 26 to secondary wing panels 28 having fastening means 30 thereon. A pair of fastening rings 32 are provided on the main panel 22 of the flap and, as shown in FIG. 4, these cooperate with a pair of swivel clips 34 which are concealed within the pockets of the garment but which can be quickly deployed for securing the flap 18 in place.

Figure 4:
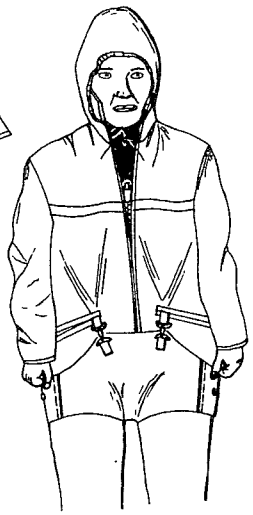

Referring particularly now to FIG. 4 it will be seen that the subject has donned the jacket and with the collar in the position illustrated, a throat flap 17 (FIG. 2) covers the high heat loss area of the neck. It will be noted that the main panel 22 of the flap has been drawn between the subject's legs and connected to the front of the jacket through the cooperation of the swivel clips 34 and rings 32. This also serves to draw the body of the jacket downwardly on the wearer to prevent flotation of it upwardly on the wearer's body. The primary wings 24 and the secondary wings 28 cooperate to form a wrapping of the upper legs or thighs of the wearer and the wings are held together through the combination of the fastening means 25 and 30.

It will be appreciated that the thermal protective flap 18 seals the legs at mid thigh and tightly covers the lower groin area to provide maximal thermal protection in this portion of the human body, and to limit access of cold water to other high heat loss areas of the trunk.

We claim:

1. A flotation jacket having front, back, and arm portions with flotation material therein to provide adequate inherent buoyancy for an adult, and a flap secured to the lower terminal edge of the jacket and foldable between a concealed position on the inside of the jacket and a deployed position suspended from the said lower edge of the jacket; said flap, in the deployed position having a main panel for passage between the legs of the wearer and securement to the front of the jacket thereby enclosing the groin area; and a pair of wing panels, one on either side of the main panel, said wing panels being adapted for encirclement of the upper thigh area; and means for securing the panels in their concealed and abdominal enclosing positions; said flap comprising waterproof insulative closed-cell material providing thermal protection to vital heat loss areas in the groin and mid-thigh area of the wearer and limiting access of cold water to other high heat loss areas of the trunk of the body.

* * * * *